United States Patent [19]

Scheiwiller

[11] Patent Number: 5,028,167

[45] Date of Patent: Jul. 2, 1991

[54] PAVING BLOCK ARRANGEMENT FOR LAYING A PAVING-SET ARC ASSEMBLY

[76] Inventor: Rolf Scheiwiller, Buolterlistrasse 9, CH-6052 Hergiswil, Switzerland

[21] Appl. No.: 418,817

[22] Filed: Oct. 4, 1989

Related U.S. Application Data

[63] Continuation of Ser. No. 180,999, Apr. 13, 1988, abandoned.

[30] Foreign Application Priority Data

Apr. 22, 1987 [EP] European Pat. Off. ..... 87810256.5

[51] Int. Cl.[5] ..... E02B 11/00; E02B 13/00

[52] U.S. Cl. ..... 404/41; 404/38

[58] Field of Search ..... 404/34, 37, 38, 41, 404/42; 52/603, 604, 605; D25/86

[56] References Cited

U.S. PATENT DOCUMENTS

| | | | |
|---|---|---|---|
| D. 278,934 | 5/1985 | Scheiwiller | D25/86 |
| 1,259,933 | 3/1918 | Trowbridge | 404/38 |
| 1,473,767 | 11/1923 | Healy | 404/41 X |
| 3,873,225 | 3/1975 | Jakobsen et al. | 404/41 |
| 4,052,131 | 10/1977 | Lowrigkeit | 404/38 |
| 4,326,817 | 4/1982 | Boiardi | 404/41 |
| 4,485,604 | 12/1984 | Palamara et al. | 52/436 |
| 4,496,266 | 1/1985 | Ruckstuhl | 404/41 |
| 4,524,551 | 6/1985 | Scheiwiller | 52/98 |

FOREIGN PATENT DOCUMENTS

| | | | |
|---|---|---|---|
| 1201000 | 2/1986 | Canada . | |
| 0082914 | 12/1981 | European Pat. Off. . | |
| 0060961 | 9/1982 | European Pat. Off. . | |
| 0114263 | 8/1984 | European Pat. Off. . | |
| 816452 | 10/1951 | Fed. Rep. of Germany . | |
| 1534201 | 2/1969 | Fed. Rep. of Germany | 404/41 |
| 2227576 | 12/1973 | Fed. Rep. of Germany . | |
| 2519225 | 11/1976 | Fed. Rep. of Germany . | |
| 2743317 | 4/1979 | Fed. Rep. of Germany | 404/41 |
| 2826661 | 12/1979 | Fed. Rep. of Germany . | |
| 8207785 | 7/1982 | Fed. Rep. of Germany . | |
| 8400131 | 5/1984 | Fed. Rep. of Germany . | |
| 8405128 | 5/1984 | Fed. Rep. of Germany . | |
| 8521274 | 11/1985 | Fed. Rep. of Germany . | |
| 8606104 | 6/1986 | Fed. Rep. of Germany . | |
| 2277936 | 4/1975 | France . | |
| 2439852 | 5/1980 | France . | |
| 000296 | 8/1980 | Int'l Pat. Institute . | |
| 67062 | 5/1981 | Int'l Pat. Institute . | |
| 433891 | 4/1948 | Italy . | |
| 24902 | of 1896 | United Kingdom . | |
| 1211099 | 11/1970 | United Kingdom . | |
| 1386088 | 3/1975 | United Kingdom . | |

OTHER PUBLICATIONS

Photograph of the River Oaks Shopping Center in Calumet City, Illinois.

Advertisement for Paving Stones.

*Primary Examiner*—Stephen J. Novosad

*Assistant Examiner*—Gay Ann Spahn

*Attorney, Agent, or Firm*—Marks Murase & White

[57] ABSTRACT

An arcuate paving block assembly comprising two outer transitional blocks (1) with four arcuate sides, wherein two adjacent sides (10, 18) are curved inwards and the other two sides (19, 20) are curved outwards in order to form a continuous transition from one arc to another; adjacent thereto on both sides an equal number of arc blocks (2, 3, 4; 2a, 3a, 4a) constructed to be mirror images of each other and symmetrical or mirror image shaped keystones of apex blocks (5, 6, 5a, 6a; 7, 7a, 8) which together make up the entire length of an arc, the whole being such that when laid the two outer edges (10) of the transitional blocks (1) enclose an angle of 90° and the height (H) of all the blocks measured at right angles to an imaginary baseline (S) through the lower corner of the transitional blocks (1) is the same. Herein the blocks have a lower portion remote from the top tread surface which extends further in the horizontal direction and an upper portion of less extent in the horizontal direction, wherein the lower portion of the radial sides (21) of the arc blocks and crown blocks and the outwardly curved sides (19, 20) of the transitional blocks (1) are provided with vertical or perpendicular projections (14, 15) and the edging of the upper portion has lateral surfaces which are irregularly formed in the same way as a natural stone.

9 Claims, 3 Drawing Sheets

PAVING BLOCK ARRANGEMENT FOR LAYING A PAVING-SET ARC ASSEMBLY

This application is a continuation of Ser. No. 07/180,999 filed on Apr. 13, 1988 now abandoned.

The present invention relates to a combination of manufactured paving blocks or sets which are arrangeable into arcuate combinations.

The arrangement of arcs of paving stones or sets with natural stone has been known for a long time, but requires specialist personnel in order to lay such, and in addition to this such arrangements are very expensive because the individual stones have to be cut by hand. Although natural stone arc arrangements are aesthetically very effective and attractive, their sometimes very uneven surfaces are not appreciated by everybody, in particular not by women. Efforts have therefore been made for a long time to provide paving stones or paving stone units, by means of which arc arrangements can be formed cheaply and with a more even surface. Thus, for example, an arc shaped paving member unit for the formation of an arc arrangement is known from DE-A-31 51 876 in which the units are subdivided into individual stones by means of non-penetrating separating channels or grooves—these units being cheaper to manufacture and easier to lay than natural stone sets. However, as a result of their construction these units have a regular and readily identifiable texture, whereas the manufacture of arc-shaped relatively large units of conventional rectangular shape is rather uneconomic.

The object of this invention is therefore to provide a combination of paving stones or blocks for laying in an arc or arcs which blocks on the one hand can be manufactured rationally and on the other hand can be laid easily, and in addition to this have an attractive appearance approximating to that of natural stone arc sets or blocks. Also these paving blocks should be compatible with other paving blocks which can be laid in straight courses. This objective is achieved by means of a paving as described in the claims.

In particular, according to the present invention there is provided a combination of paving blocks for forming arcuate paving arrangements comprising outer bridging blocks each with four arcuate sides, wherein two adjacent sides are curved inwards and the other two sides are curved outwards in order in use to form a continuous transition from one arc to another; adjacent thereto an equal number of arc-forming paving blocks disposable on opposite sides of an arc and shaped to form mirror images of each other and adjacent to said arc-forming paving blocks, symmetrical or mirror image shaped apex or crown paving blocks which blocks together make up the entire length of the arc arrangement, the whole being in such a form that when laid the two outer edges of the bridging blocks include an angle of 90° and the height (H) of all the blocks measured at right angles to an imaginary baseline (S) through the bottom corner of the bridging blocks is the same.

The invention will be described further, by way of example, with reference to the accompanying drawings, in which.

Figure 1:
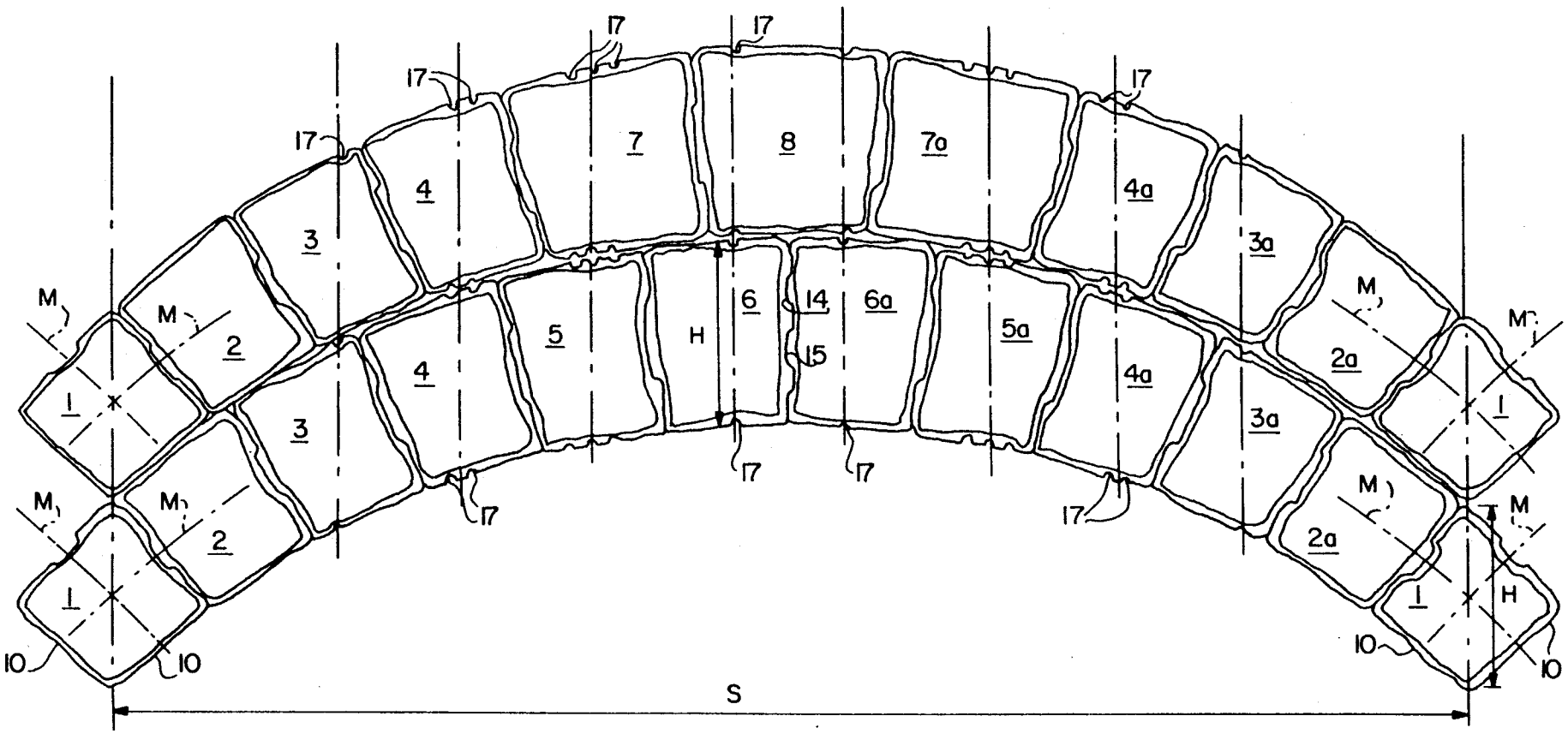
FIG. 1 is a plan view of two courses providing a curved paving block arrangement.
Figure 2:
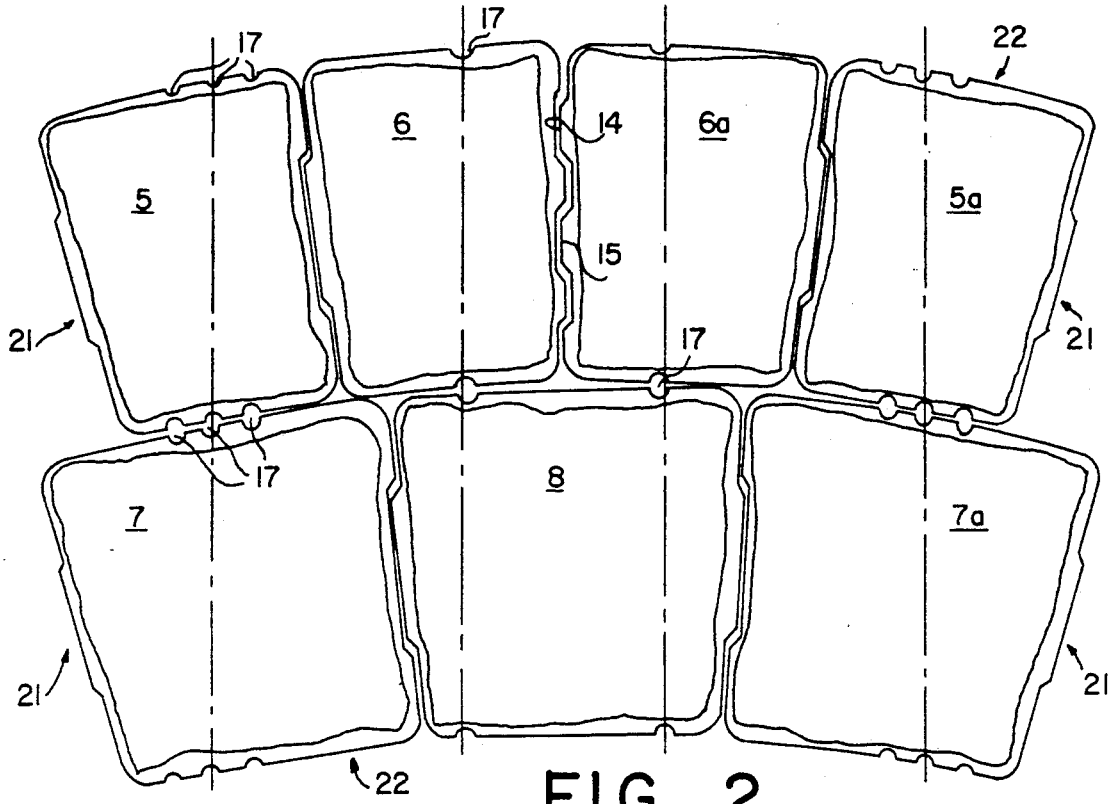
FIG. 2 is a plan view of the apex of the courses of blocks on an enlarged scale.

In FIG. 1 there are illustrated two arcuate courses of pre-formed discrete paving stones or blocks in accordance with the invention in arcuate arrangement. The lower of the two courses has at each end an identical transition of bridging stones or blocks 1 and then, inwardly thereof has three arch stones or blocks 2, 3, 4 and three correspondingly mirror-image arc stones or blocks 2*a*, 3*a* and 4*a*.

The blocks 1 each have upper and lower faces or sides and four curved or arcuate sides wherein two adjacent sides 10, 18 are concave or curved inwards and the other two sides 19, 20 are convex or curved outwards such as to enable a continuous transition to be formed from one arc to the next.

In this arc arrangement, or arc forming unit, the mentioned blocks are supplemented by two apex stones or crown block 5 and 5*a* and two crown blocks 6 and 6*a*, making four crown blocks in all and where also the two crown blocks 5*a* and 6*a* are mirror images of the two crown blocks 5 and 6. The upper course likewise includes the two bridging blocks 1 and the two groups of three arc blocks 2, 3, 4 and 3*a*, 4*a* and 5*a* respectively. Instead of the four apex or crown blocks of the lower course 5, 5*a* and 6, 6*a*, the upper course has two apex or crown blocks 7 and 7*a* which are likewise mirror images of each other, and a keystone or middle or top block 8. The length of arc of the four crown blocks 5, 5*a* and 6, 6*a* of the lower course is the same as that of the three blocks 7, 7*a* and 8 of the upper course so that these blocks can be inserted at will.

In the development of the paving block arrangements the fundamental premise was that its appearance should match that of known paving stone arrangements in order to provide an even transition to normal pavings and to achieve a certain standardisation. In the preferred embodiment the starting point for the rectangular normal unit is a paving unit known by the name of CITY PARK which is described in detail in EP-B-0060 961 and is indicated by the number 9 in the variant embodiment illustrated in FIG. 4. This square paving unit has an edge length of 180 mm so that the grid in FIG. 1, i.e. the distance between centres or the diagonals of transitional blocks 1, is likewise 180 mm. If one assumes the normal width for a passageway, i.e. 1250 mm, as the span width S on which an arc or curve is based, and applies the condition that the outer edges 10 of the transitional blocks should include an angle of 90°, then the radius r of the centre line M of the circular arc $r=S/\sqrt{2}=883.9$ mm. As is usual in the case of arc pavings, the arc drawn at right angles to the baseline S always has the same height H of 180 mm. These figures and dimensions are purely by way of example and largely relate to the specification or selection of the particular paving unit used as a basis. Obviously another grid dimension can be used as a basis so that there is a larger or a smaller number of units in a course. It is important however that the two transitional blocks at the ends are identical and that the number of blocks on both sides is the same and that these are mirror images of each other.

Figure 4:
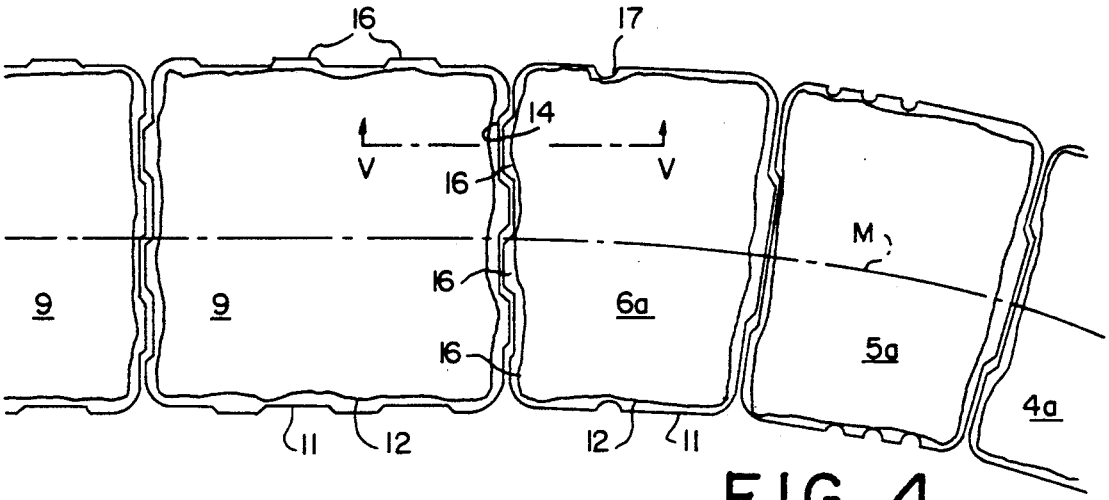
FIG. 4 is an enlarged fragmentary detail of an alternative embodiment.
Figure 5:
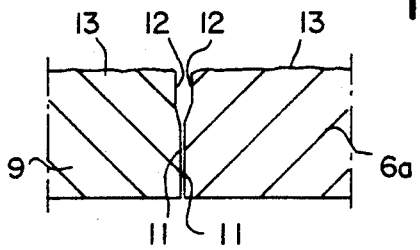
FIG. 5 is a cross-sectional along the line V—V in FIG. 4.
Figure 6:
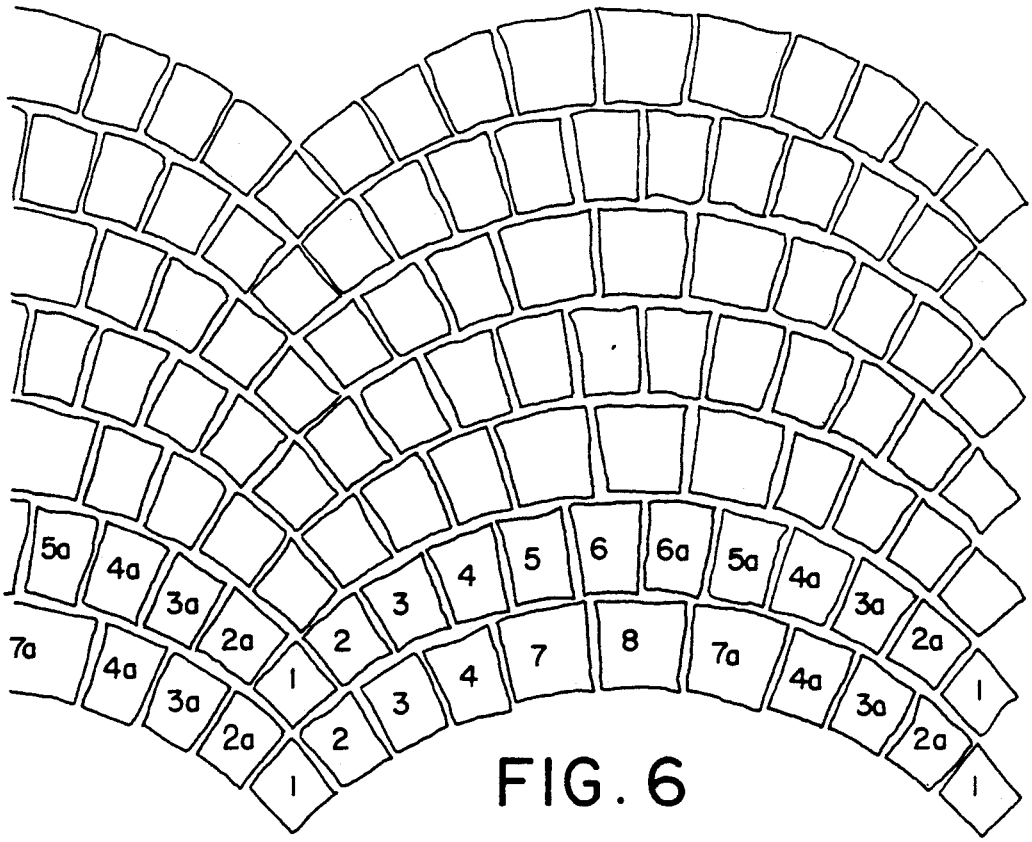
FIG. 6 is a plan view of a section of an arc arrangement made with set arrangement in accordance with the invention.

However, not only have the dimensions of the known paving unit 9 been used as a basis, but also its appearance and shape. Thus it is a characteristic of the known paving unit that in thickness it has two different portions, i.e. as seen in a vertical direction the lower portion is provided with a wider projection and the upper portion is constructed independently of this projection in such a way that on the one hand the lower projection cannot be seen when located and on the other hand the surface has the appearance of a natural stone. This means that the side surfaces of the upper part are irregular. As shown in FIG. 5, all the units in the course have a lower portion 11, which extends further in horizontal cross-section, and an upper portion 12 with irregular side surfaces, while upper surface 13 is slightly wavy as in the example given and thus is slip resistant. All the blocks in the course with the exception of the two transitional blocks 1 have projections on the lower portion 11 of radial sides 21 which differ as shown in FIG. 1. Projections 14 and 15 of the adjacent sides of the two crown blocks 6 and 6*a* in the lower course correspond with the projections of the normal facing unit 9, see FIG. 4, and each have three projections 16 by means of which, as shown in FIG. 4, they can if necessary pass without discontinuity into normal paving. In this example therefore only one projection is present in the radial direction. This obviously also applies for the transitional blocks in which the projection is of course found on the two adjacent sides.

FIG. 1 shows that with the exception of the projection just described on crown blocks 6 and 6*a*, the projections on the various blocks are not identical. Starting from the keystones or crown blocks it will be seen that the projections located at the centre points of the blocks are always directed outwards, i.e. towards the bridging blocks 1, and that there is a recess which corresponds to these. It may also be seen from FIG. 1 that the distance from the outer edge of a block to the edge of the projection is always the same, so that the length of the projection decreases from the centre towards the transitional blocks. The transitional blocks always have a recess in the middle of the two adjacent sides in order to engage the projections on the next arc block.

Figure 3:
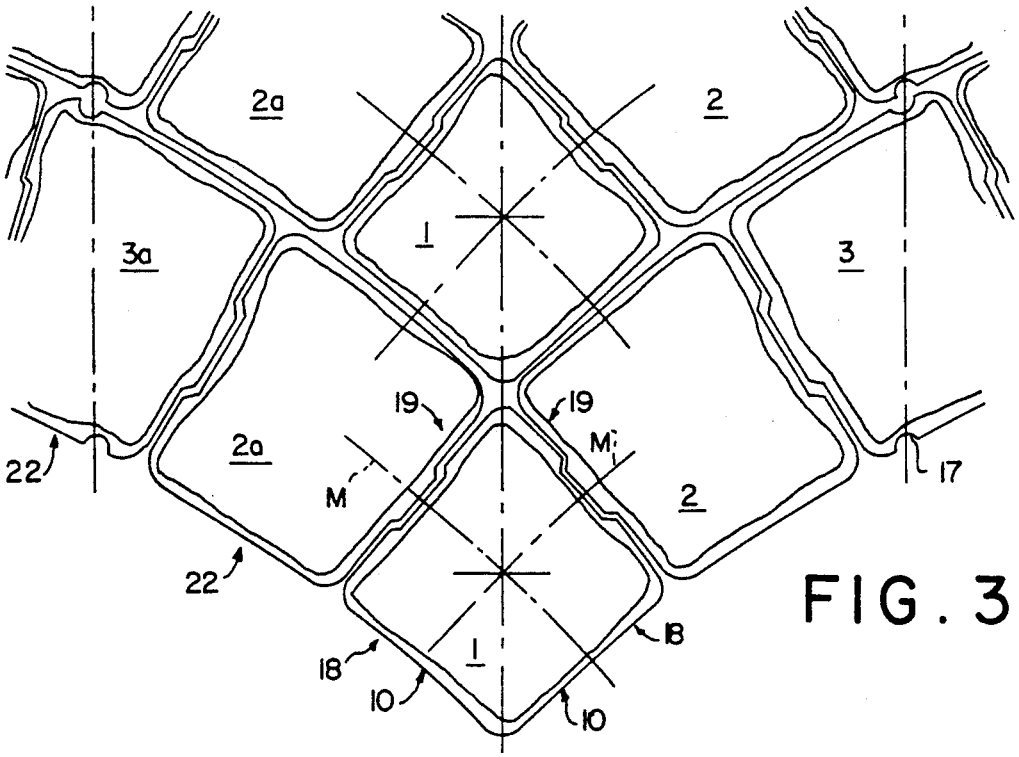
FIG. 3 is a plan view of the transitional region from one arc arrangement to a neighbouring arc arrangement on a scale.

FIG. 3 shows most clearly that all four sides of the bridging blocks are of an arcuate shape, in such a way that there is a continuous transition from one arc to the next, as may clearly be seen in the transitional position illustrated in FIG. 3. Here the two adjacent sides 18 are concave or curved inwards and the two other sides 19 are convex or curved outwards. Obviously arcuate sides 22 of the other blocks are also constructed in this way so that the desired circular arc can be achieved, while the radial sides, with the exception of the sides bounding the first arc blocks 2 and 2*a* on the transitional blocks, are straight. As a result there is a continuous transition from one arc to another without any visibly obvious discontinuities.

As the paving blocks or units are delivered on pallets and each unit in a course has its specific place, the individual units in a course must be marked or identified. In the example provided this is achieved by means of a specific number of marking or identification grooves 17 on each block, as is shown in FIG. 1. Transitional blocks 1, which differ from the other blocks in that they have indentations or no indentations on two adjacent sides must not be marked. The first two arc blocks 2 and 2*a* can be identified by the fact that they have no markings, while the subsequent blocks have 1, 2 or 3 grooves, and the two upper or crown blocks 6 and 6*a* and keystone or crown block 8 each have one or two grooves. As the two crown blocks 6 and 6*a* have another projection on their sides in addition to those on the other blocks these blocks can readily be identified. The same applies for crown block 8, which is the only one to have projections on two opposite sides. FIG. 1 also shows that the individual grooves are always placed on the blocks in such a way that they are always at right angles to each other when laid, in relation to the baseline S. In this way these grooves can be used as a guide when laying individual courses.

In addition to the different possible dimensions of the paving blocks already mentioned, all known materials and colouring agents may be used for the manufacture of these blocks in order to match these paving blocks with standard facing units or to produce a deliberate difference.

It will be seen from the description that these arc paving blocks can be manufactured using the same machine as is used for other paving blocks, but obviously using different moulds.

I claim:

1. A combination of paving blocks for forming arcuate paving arrangements with each arc being assembled from;

two discrete outer bridging blocks each with an upper surface, a lower surface and four arcuate sides, namely an outer side, an inner side, a lower side and an upper side, wherein the outer side and the lower side are adjacent and curved inwards and the inner side and the upper side are curved outwards, the outer side and the lower side forming a bottom corner;

an equal number of discrete arc-forming blocks to be placed on oppositely positioned first and second sides of an arc adjacent to said bridging blocks and shaped so that the first side of the arc forms a mirror image of the second side; and discrete crown blocks, adjacent to said arc blocks, which are symmetrical or mirror image shaped;

wherein these blocks together form the arc and so that when laid the outer sides of the two bridging blocks include an angle of 90°; and each block has the same height, the height being measured at right angles to an imaginary baseline through the bottom corner of the bridging blocks.

2. A combination according to claim 1, wherein each of the blocks in said combination is clearly identified by means of a different number of marking grooves, wherein the grooves on each block in the combination are applied to each of the two upper and lower sides in such a manner that a line connecting the two grooves is parallel to the center axis of the arc.

3. A combination according to claim 1 or 2, wherein each block comprises an upper portion having a smaller cross-sectional area and a shorter height with side surfaces that are irregularly formed in the same manner as, and to give the appearance of, a natural stone; and a lower portion having a larger cross-sectional area and a taller height with side surfaces provided with toothing or perpendicularly extending projections.

4. A combination according to claim 3, wherein each of said projections is formed from a rib located in the center of a side which is adjacent to another block in the arc, with a corresponding recess in the adjacent block, wherein the distance between the edge of the block and the edge of the rib is the same for all the blocks.

5. A combination according to claim 3, wherein the two uppermost crown blocks which are adjacent to each other each have three projections on the respective adjacent sides which are the same as that of a straight course of paving blocks.

6. A combination according to claim 1, wherein said combination of paving blocks in an arcuate paving stone arrangement is joined to paving blocks laid in linear courses which are square and have a side length corresponding to the height of the arc.

7. A combination according to claim 1, comprising two bridging blocks, two groups of three arc blocks, and crown blocks, either in the form of two groups of two crown blocks or three crown blocks where the total length of arc is the same for either form, wherein the arc height is 180 mm, the span of the laid combination of paving blocks is 1250 mm and the radius of the center line of the laid arc is 883.9 mm.

8. A kit for forming arcuate paving arrangements comprising for each arc two discrete outer bridging blocks each with an upper surface, a lower surface and four arcuate sides, namely an outer side, an inner side, an upper side and a lower side, wherein the outer side and the lower side are adjacent and curved inwards and the inner side and the upper side are curved outwards, the outer side and the lower side forming a bottom corner;

an equal number of discrete arc-forming blocks to be placed on oppositely positioned first and second sides of an arc adjacent to said bridging blocks and shaped so that the first side of the arc forms a mirror image of the second side; and discrete crown blocks, adjacent to said arc blocks, which are symmetrical or mirror image shaped;

wherein these blocks together form the arc and so that when laid the outer sides of the two bridging blocks include an angle of 90°; and each block has the same height, the height being measured at right angles to an imaginary baseline through the bottom corner of the bridging blocks.

9. A paving block comprising an upper portion having an upper surface with a cross-sectional area, a lower portion having a lower surface with a cross-sectional area and four arcuate sides, the paving block being discrete, wherein two adjacent arcuate sides are curved inwards and the other two arcuate sides are curved outwards;

the upper surface has a cross-sectional area smaller than the cross-sectional area of the lower surface;

the upper portion has a depth with side surfaces that are irregularly formed in the same manner as, and to give the appearance of, a natural stone;

the lower portion has a depth with side surfaces provided with toothing or perpendicularly extending projections; and the upper portion is shorter in depth than the lower portion.

* * * * *